United States Patent [19]

Jury

[11] 4,033,320

[45] July 5, 1977

[54] FURNACE AND COLD AIR RETURN SYSTEMS

[76] Inventor: Gene R. Jury, 125 Ridgeway Drive, Greenwood, Mo. 64034

[22] Filed: Oct. 2, 1975

[21] Appl. No.: 618,942

Related U.S. Application Data

[62] Division of Ser. No. 488,564, July 15, 1974, Pat. No. 3,926,173.

[52] U.S. Cl. ..... 126/110 R
[51] Int. Cl.² ..... F24H 3/00; F24H 3/02
[58] Field of Search ..... 126/99 R, 110 R, 116 R; 165/163, 143, 176; 237/55, 81

[56] References Cited

UNITED STATES PATENTS

| | | | |
|---|---|---|---|
| 1,674,337 | 6/1928 | Klees et al. | 126/116 R |
| 2,290,255 | 7/1942 | Smith | 126/110 R |
| 2,504,315 | 4/1950 | Feuerfile | 126/116 R |
| 2,523,412 | 9/1950 | Bauer | 126/116 R |
| 2,603,208 | 7/1952 | Beauchamp | 126/116 R |
| 3,695,345 | 10/1972 | Moreland | 126/110 R |

*Primary Examiner*—Robert G. Nilson
*Attorney, Agent, or Firm*—Thomas M. Scofield

[57] ABSTRACT

Improved methods of extracting heat from hot exhaust gases from a heat source adjacent elements of a forced air circulating heating system and apparatus therefor; improvements in methods of completely extracting heat from the combustion gases of a hot air furnace within the furnace plenum and apparatus therefor.

15 Claims, 4 Drawing Figures

Fig. 3.
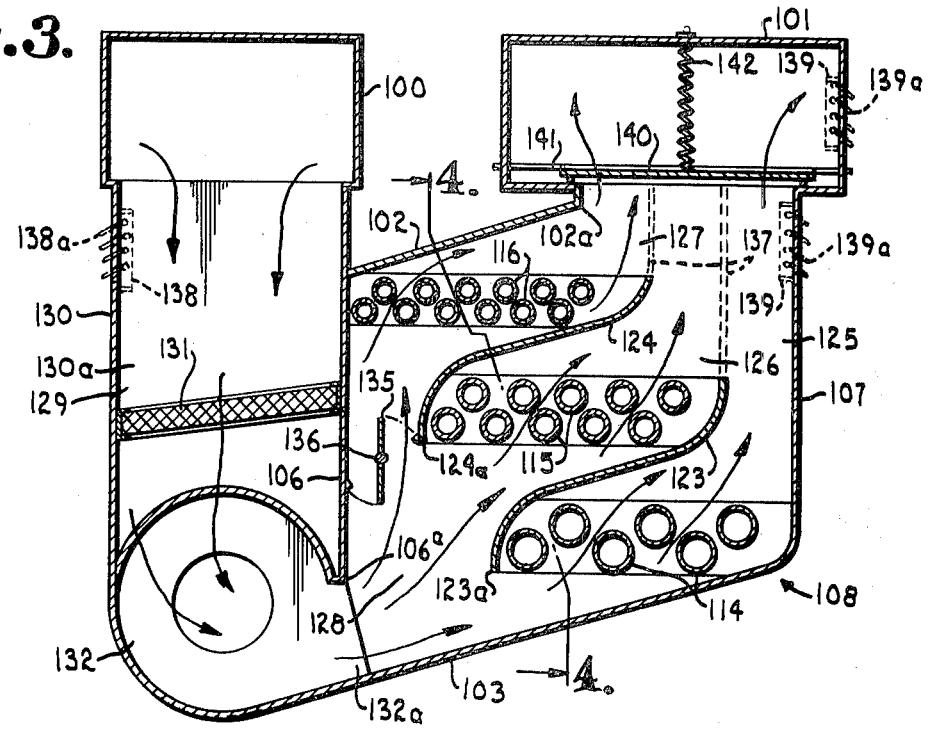
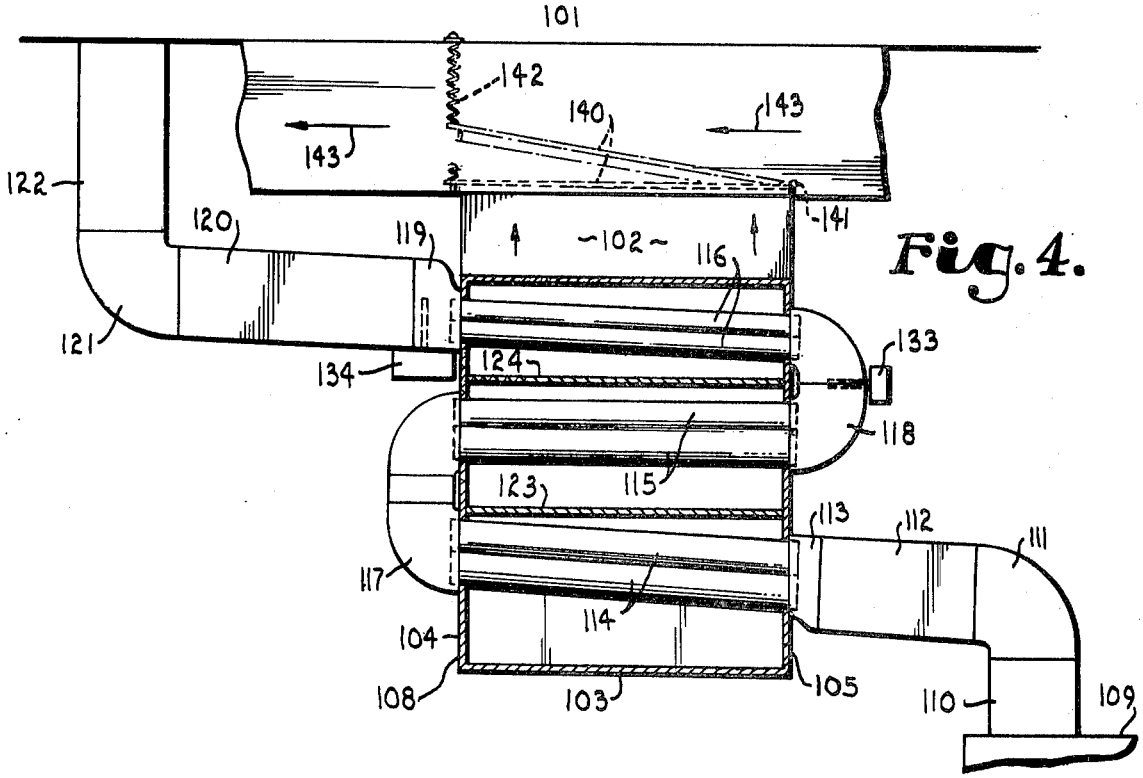
Fig. 4.

FURNACE AND COLD AIR RETURN SYSTEMS

This is a division of application Ser. No. 488,564, filed July 15, 1974 now U.S. Pat. No. 3,926,173.

BACKGROUND OF THE INVENTION

It is well known to the prior art to provide furnace heat exchange systems in which the products of combustion (exhaust) are passed through the furnace in a zig-zag fasion. This is shown in the following patents.

1. Bartlett U.S. Pat. No. 101,082 "Hot Air Furnace," Issued Mar. 22, 1870;
2. Twitchell et al U.S. Pat. No. 559,918, Issued May 12, 1896 for "Heating and Ventilating Furnace";
3. Kuhner U.S. Pat. No. 2,479,940 "Multiple Tube Air Heating Furnace" Issued Aug. 23, 1949;
4. Feuerfile U.S. Pat. No. 2,504,315 "Fluid Heater and Thermostatic Control Means Therefor," Issued Apr. 18, 1950; and
5. Eichhorn U.S. Pat. No. 2,685,875 Issued Aug. 10, 1954 for "Warm Air Heating Furnace."

Further, it is known to provide furnaces or systems in which the air to be heated is passed through the furnace in a zig-zag manner. This is seen in the following patent:

1. Bartlett U.S. Pat. No. 12,305 "Hot Air Furnace," Issued Jan. 30, 1855;
2. Wallace U.S. Pat. No. 54,795 "Hot Air Furnace," Issued May 15, 1866;
3. Engels et al U.S. Pat. No. 63,490 Issued Apr. 2, 1867 for "Hot Air Furnace."

Yet further, furnace systems are well known in which both the air to be heated and the products of combustion zig-zag through the furnace construction. Such are seen in the following patents:

1. Pessenger U.S. Pat. No. 346,770 Issued Aug. 3, 1886 for "Heating Furnace";
2. Smith U.S. Pat. No. 2,290,255 Issued July 21, 1942 for "Furnace";
3. Norton U.S. Pat. No. 2,363,742, Issued Nov. 28, 1944 for "Furnace"; and
4. Powers U.S. Pat. No. 2,225,181, Issued Dec. 17, 1940 for "Heating and Air Conditioning Unit."

The subject systems and apparatus are designed to provide improvements in the extraction of heat which are not known to the prior art and which will provide and achieve energy conservation effects of significant magnitude in the most simple and conventional present day systems which are not capable of functioning with the efficiency which the future will require.

OBJECTS OF THE INVENTION

An object of the instant invention is to provide improved means for increasing efficiency in hot air home furnaces and the air circulation systems associated therewith.

Another object of the invention is to provide a hot air home furnace system which is designed and effective to extract the maximum amount of heat from the gases produced from the heating or combustion chamber, before such gases exhaust up and out of the vent or chimney into the atmosphere.

Another object of the invention is to provide an improved hot air home furnace system which will extract heat from the combustion gases of the furnace to such an extent that such gases will exhaust at approximately 85° (as compared to the exhaust of most present furnace systems which exhaust at approximately 200° or hotter) thus providing additional fire protection by cutting down the fire hazard of an over-heated flue (the latter the cause of many home fires during cold weather).

Another object of the invention is to provide an improved hot air home furnance system wherein the return cold air recycled through the furnace is exposed to a plurality of heat exchanging stages as it passes therethrough, whereby to produce an average temperature of approximately 245° to 275° air, which heated air would then flow into the plenum to be distributed through the heat ducts.

Another object of the invention is to provide an improved hot air home furnace system wherein the cold air return to the furnace is exposed to a plurality of heat exchange steps or stages consisting of, in each stage, a plurality of tubes carrying the combustion gases from the heating chamber, the number of stages to which the air to be heated is exposed damper controlled, depending upon the circumstances.

Another object of the invention is to provide a versatile, improved hot air home furnace system wherein, in small systems, a single blower will suffice, in combination with suitable damper controls, to obtain the desired heat exchanging effect, wherein multi-speed blowers or a plurality of blowers may be employed for larger or more complex systems.

Another object of the invention is to provide a novel, improved, home furnace hot air system wherein the combustion gases from the combustion chamber are collected, manifolded and passed a plurality of times transversely of the furnace plenum, whereby a plurality of stages of heat exchange are provided through which the air circulated through the furnace for heating is passed, the flow of air with respect to the successive heat exchange zones regulated by dampers and (in some cases) blower positions and activations to obtain the maximum heat exchanging effect and efficiency in the system.

Another object of the invention is to provide simple, relatively cheap, efficient, energy conserving means whereby the effectiveness and efficiency of hot air home furnaces may be greatly upgraded and improved.

Another object of the invention is to provide an improved hot air home furnace system wherein the furnace is provided therewithin with so large an area of heat exchange surface that substantially all of the heat generated from combustion of fuel in the combustion chamber thereof is communicated to the air passed through the plenum or air spaces of the furnace, except that amount which creates the chimney draft.

Another object of the invention is to provide an improved heat exchanging system for hot air home furnaces wherein the furnace itself is of relatively simple and inexpensive construction capable of operating efficiently throughout a long life of useful service, wherein the heat of the burning fuel is substantially entirely utilized while being arranged to avoid any contamination of the air being heated by the gaseous products of combustion, and wherein the various parts of the furnace are adequately protected against overheating.

Another object of the invention is to provide a novel, highly efficient warm air furnace which is comparatively simple in construction and requires a minimum amount of space while obtaining great heating efficiency, same quickly and easily manufactured and conveniently assembled in domestic heating installations.

Another object of the invention is to provide a warm air heating furnace in which the products of combustion are collected from one side of the combustion chamber and follow a sinuous pathway to and fro, upwardly through the plenum of the furnace, the air circulated through the furnace plenum to be heated being passed through the plurality of levels of such pathway in a controlled manner whereby to increase heating efficiency of the furnace.

Another object of the invention is to provide a staggered series of banks or sets of heat exchange elements containing heated gases or combustion gases from a source of heat in a communication between a hot air plenum and a cold air return duct (such as in a space therebetween or a furnace interconnecting same) whereby all of the cold air is passed through a plurality of such heat exchanging sets or banks in controlled fashion, thereby to maximize the heat exchange between the cold air and the heated gases or combustion gases.

Another object of the invention is to provide simple, effective, cheap and readily adopted means which will efficiently extract heat from hot exhaust gases which are flowing out and up into atmosphere through a vent or chimney.

Another object of the invention is to provide improved means for extracting heat from the exhaust gases produced by forced air home furnace systems and gas hot water home heaters or from an existing boiler of a hot water heating system, whereby the basement of a house may be heated by such, or, with some duct work, a garage or the like.

Another object of the invention is to provide means which may readily, swiftly and conveniently be coupled with the outlet or exhaust from a source of heat which will furnish efficient heat exchanging means for extracting heat from such exhaust and capturing it into a home air circulating system.

Other and further objects of the invention will appear in the course of the following description thereof.

In the drawings, which form a part of the instant specification and are to be read in conjunction therewith, embodiments of the invention are shown and, in the various views, like numerals are employed to indicate like parts.

FIG. 3 is a side, sectional view of a portion of a conventional forced air heating system, including a cold air return duct and a hot air circulation duct with an improved heat exchanging system to capture heat from the exhaust of an adjacent heat source coupled with said ducts.

FIG. 4 is a view taken along the lines 4—4 of FIG. 3 in the direction of the arrows.

Figure 1:
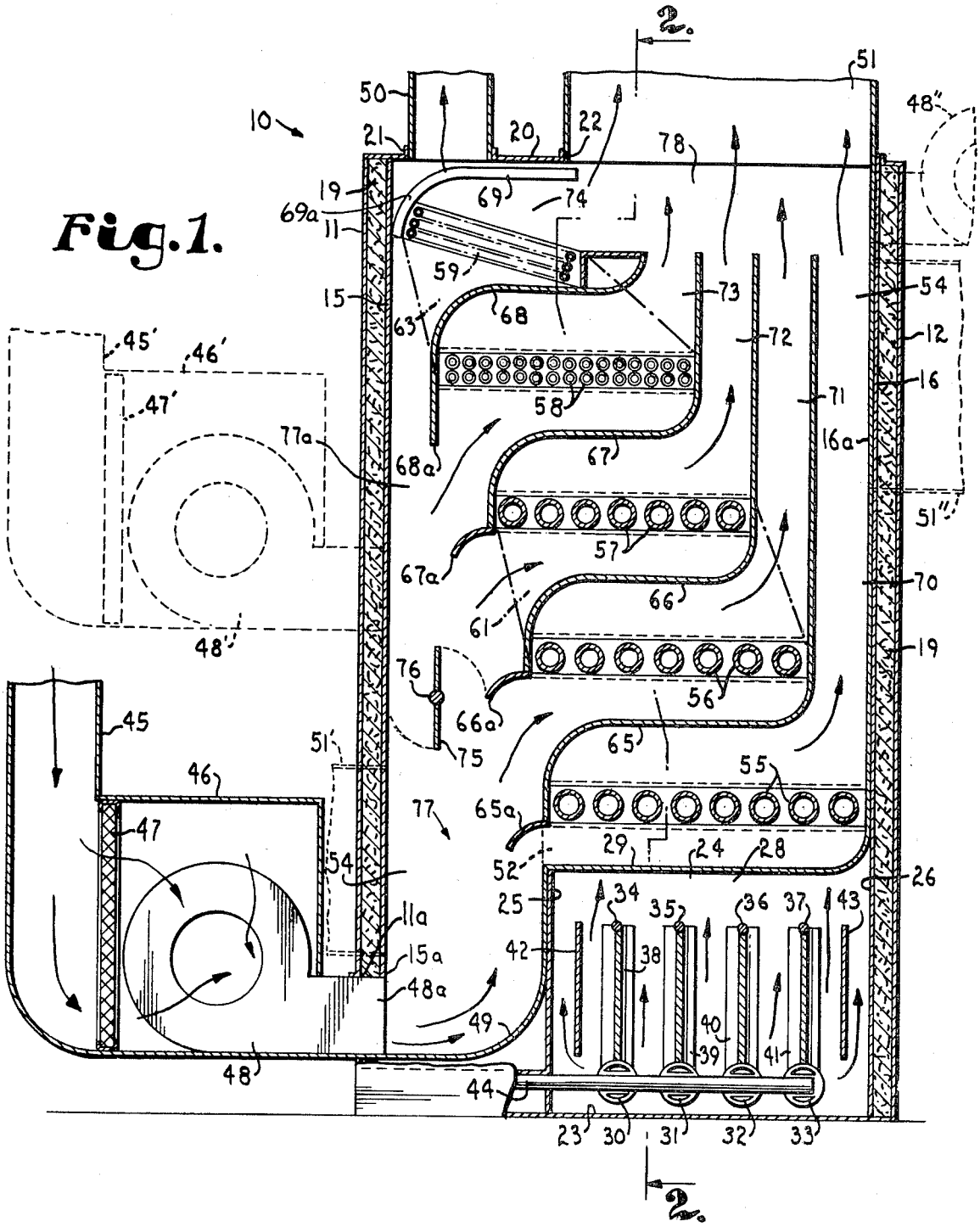
FIG. 1 is a side, sectional view through a home hot air furnace with the improved heat exchanging means installed therewithin. An optional accessory blower is shown in dotted lines.
Figure 2:
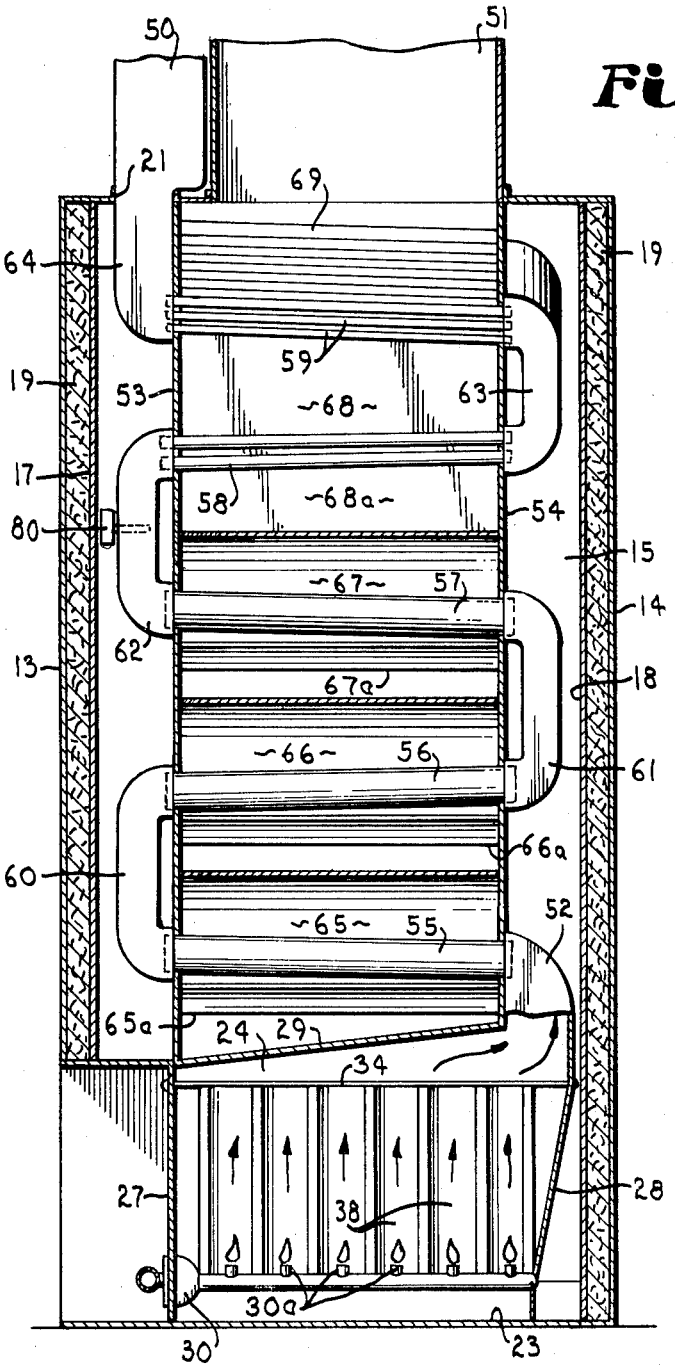
FIG. 2 is a view taken along the lines 2—2 of FIG. 1 in the direction of the arrows.

FIGS. 1 and 2 - HOT AIR FURNACE IMPROVEMENT

The improved hot air furnace construction and air heating method and system of FIGS. 1 and 2 is designed to extract the maximum amount of heat from that produced by the combustion or heating chamber, before the exhaust gases therefrom are exhausted upwardly and out of the vent or chimney into the atmosphere.

In the majority of current commercially available furnace systems, gases from the combustion chamber of the furnace exhaust at approximately 200° F (or hotter) at the point of vent connection to the furnace. The instant improved furnace and heat exchange system therefor are designed to reduce the temperature of such exhaust gases to approximately 85° F at the venting point. It is well known that hot exhaust gases will rise and provide proper venting if same are approximately 15° to 20° warmer than the atmospheric temperature.

The illustrated and described improved system and furnace construction is designed to have a necessary number of discrete heat exchanging stages wherein the first stage produces the hottest air (at approximately 400° to 450° F) flowing the overhead mixing chamber prior to the hot air plenum, with the last heat exchanging stage producing hot air of approximately 85° to 100° F flowing into such miximg chamber. The combine products of all the separate and discrete, ducted heat exchanging stages produces an overall output of air into the hot air plenum of approximately a temperature of 245° to 275° F. This air, then, at that temperature, would be distributed from the hot air plenum throughout the heat ducts.

For greatest efficiency, the burner area in the combustion or heat producing chamber can be provided with and should have radiant fire bricks, thereby to radiate and provide more heat on less fuel, achieving the maximum combustion efficiency and minimizing fuel waste.

In relatively smaller forced air heating systems, requiring a relatively smaller furnace, it is possible for one blower to handle the work involved. One or more air flow control dampers may be employed, as will be described, to limit or close off the flow of cold air from the cold air return duct through certain of the heat exchanging stages until the desired temperature is reached in the more remote heat exchange stages. Further, a multi-speed blower may be used in conjunction with such damper control so that the blower speed increases as the damper opens.

On larger systems, as will be described, it may be necessary to use two or more blowers. These also may be dampered as previously described and also be multi-speed. Such blowers may additionally be heat level controlled.

In any case, the ducting with respect to the sets of heat exchange tubes and the spacing of the tubes with respect to one another is so controlled that the blower capacity is matched to the flow capacity of the stages.

The discrete or separate heat exchanging stages consist of sets of tubes running parallel with and spaced away from one another whereby to permit the flow of the cold air, under blower impetus, to pass therethrough but require heat exchange therefrom. The set, bank or stage nearest the combustion chamber (first receiving the hot exhaust gases therefrom) typically has tubes larger in diameter and less in number. The diameter of the tubes in successive stages typically decreases, while the number thereof typically increases. The heat exchange tubes in one or more stages may have fins thereon in order to facilitate heat transfer between the cold air passing next to the heat exchange tubes and the hot gases therewithin.

Referring, then, to FIGS. 1 and 2, therein is shown an improved, hot air furnace construction of the type used in a forced air heating system. Furnace 10, generally designated, has front and rear outer walls 11 and 12, respectively and outer side walls 13 and 14. There is additionally preferably provided inner walls spaced from the outer walls comprising front inner wall 15, rear inner wall 16 and side inner walls 17 and 18, respectively. Conventional and suitable fireproof insulation 19 is preferably received between inner and outer sets of vertical walls. There is additionally provided a top wall 20 through which pass openings for the combustion chamber exhaust gases 21 and the hot air plenum 22. Completing the furnace construction is floor 23.

Positioned within the lower rear part of furnace 10 is a combustion chamber or heating chamber generally designated 24. Combustion chamber 24 has front defining wall 25 and rear wall 26 which may be the lower portion of inner wall 16. Chamber 24 also has side walls 27 and 28 and inclined top wall 29.

Received within the lower part of combustion chamber 24 are a plurality of burners 30–33, inclusive which extend between and are mounted by side walls 27 and 28 in fixed, spaced relationship with one another. Each burner typically has a plurality of individual outlets (for example see 30*a* in FIG. 2) therealong. Frames 34–37, inclusive receive and support radiant fire brick assemblies 38–41, inclusive centrally above burners 30–33, inclusive which have burner nozzles on each side of the fire brick assembly thereof. Radiant shields 41 and 43 are preferably provided in the combustion chamber between the front and rear burners 30 and 33 and the front and rear walls 25 and 26. Feed pipe 44 carries a combustible mixture of gas and air or gas to be burned in gas burners 30–33, inclusive. Oil fired burners or even wood or coal may be the source of heat in the combustion chamber.

Looking to the lower left in FIG. 1, there is provided a primary cold air return duct 45 which opens into housing 46. Housing 46 typically contains removable and replaceable air filter 47 as well as centrifugal fan or blower 48. The discharge nozzle 48*a* of blower 48 passes through openings 11*a* and 15*a* in front outer and inner walls, respectively, to discharge the cold return air into the front lower part of the furnace. An arcuate wall 49 is preferably provided opposite the discharge snout 48*a* to provide less turbulent forced air input into furnace 10.

It should be understood that the furnace of FIGS. 1 and 2 may be as wide as desired (view of FIG. 2). In such case, a plurality of blowers 48 might be employed. Positioned above the return duct 45 and chamber 46 in the view of FIG. 1 is seen (in the dotted line showing) an optional alternative system showing an additional cold air return duct 45', an additional chamber 46', the latter receiving filter 47' and blower 48'. This optional alternative structure, if present, will provide additional capacity and versatility to the system as will be described.

At the top of the furnace, vent duct 50 discharges heat exchanged exhaust gases from the combustion chamber 24 after heat exchange in structure to be described. Hot air plenum 51 receives air heated in the furnace by the heat exchange means and system to be described, collecting same prior to passage of the heated air into the hot air distribution ducts of the forced air heating system.

Looking in the lower lefthand portion of FIG. 2, the hot combustion gases from the burners 30–33, inclusive rise above the radiant fire brick assembly and radiant shields 42 and 43 and are collected overhead (guided by inclined wall 29) in a first manifold 52.

Spaced inwardly from side walls 17 and 18 are two vertical, parallel innermost walls 53 and 54 which extend between and sealingly abut against or connect to front and rear inner walls 15 and 16 or, in the latter case the double wall 16*a* (FIG. 1, right side), if the latter is present. Walls 53 and 54 extend the entire height of the furnace outside of the combustion chamber 24. A plurality of sets of heat exchange tubes 55, 56, 57 and 58 are provided within the plenum chamber of the furnace 10 extending between and through walls 53 and 54 and supported thereby. The plenum chamber of the instant furnace 10 (working plenum) is that space which is between innermost side walls 53 and 54 and inner front and rear walls 15 and 16*a*, below top wall 20 and above arcuate bottom wall 49 and combustion chamber top wall 29. The blower or blowers 48 and 48' discharge into this working plenum between innermost side walls 53 and 54.

Additional manifolds 60–64, inclusive interconnect adjacent ends of two banks 55 and 56, 56 and 57, 57 and 58, 58 and 59 and 59 and vent 50, respectively. These manifolds are positioned outboard of innermost side walls 53 and 54 and outside of the working furnace plenum chamber.

There is additionally provided within the working plenum of the furnace, extending between innermost side walls 53 and 54 walls 65–69, inclusive. These walls, together with wall 29 of the combustion chamber 24 define between themselves a plurality of heat exchange ducts or passageways 70–74, inclusive. Each of these passageways 70–74, inclusive contains one set, bank or gaggle of heat exchanging tubes. Since the banks 55–59, inclusive are staggered from the lower rear of the plenum (above combustion chamber 24) to the upper front of the working plenum of the furnace, the arcuate, scoop, front ends 65*a*–69*a* of walls 65–69, inclusive are also staggered forwardly within the front of the working furnace plenum thus to guide air into the ducts 70–74, inclusive.

A damper 75 is pivotally mounted on rod 76 opposite the front end 66*a* of wall 66 whereby the damper 75 may block off the upper portion of the working furnace plenum above wall 66. Thus, all the air input into the lower end of the working furnace plenum is forced to go through ducts 70 and 71 below walls 65 and 66, then through heat exchange in banks 55 and 56. The damper 75 and the front end of wall 66 are both positioned below the input level of the blower 48', if the latter is present. Sensor 80 (FIG. 2) maybe provided in manifold 62 to control the action of damper 75 and/or blower 48'. This also may be coupled with blower 48 to increase its speed as damper 75 opens.

In fundamental operation of the furnace of FIGS. 1 and 2, the system starts with the gas burners 30–33, inclusive off (no combustion within chamber 24) and, also, blower 48 off. When a heat demand comes into the furnace from a thermostat in the work space to be heated by the furnace, or if the furnace is switched on by hand, the burners ignite and combustion gases are supplied through pipe 44. Combustion chamber 24 exhausts hot exhaust gases into first manifold 52 which then pass into the lowermost bank or set of heat exchange tubes 55. For greatest heat exchange efficiency, the lowermost heat exchange tubes 55 are preferably less in number and larger in diameter than those sets or banks of tubes thereabove, whereby the heat exchange tubes in bank 59 are of least diameter and greatest number. Some or all of the tubes in some or all of the sets 55–59, inclusive may be finned on the external side thereof for greater efficiency in heat exchange.

The hot exhaust gases, heating the tube banks 55–59, inclusive pass back and forth at substantially horizontal levels in the working furnace plenum, transmitted from one lower bank to a higher bank of heat exchange tubes by the successive manifolds 60–63, inclusive, with the last manifold 64 exhausting the cooled exhaust gases out of vent pipe 50. Since the exhaust gases lose heat to the tubes in banks 55–69, inclusive they are considerably colder when exhausted out vent 50. The lower tube banks reach the highest temperature first and maintain the higher temperature.

After a timed delay wherein the combustion chamber heats up, blower 48 is switched on and cold air from cold air return duct is forced into the working furnace plenum. If the delay is short (or optionally at any rate) damper 75 may be initially closed to force all such air into ducts 70 and 71 so that the initial hot air supplied by the furnace 10 into hot air plenum 51 is at as elevated a temperature as possible. As time passes under the latter condition (damper 75 initially closed), the damper 75 is opened so that air in the working plenum passes through all of the ducts 70–74, inclusive.

It should be noted that the working plenum of the furnace has clear zones 77 in the lefthand portion of FIG. 1 (lower front portion of the furnace) and **77*a* thereabove ahead of the ducts 70–74, inclusive. Likewise, walls 65–69, inclusive end short of top wall 20 whereby to provide a mixing zone 78 for the hot air prior to passing into plenum 51. Each of the duct walls 65–68, inclusive may terminate immediately after the respective tube bank 56–59, inclusive or at any point intermediate the duct wall lengths shown to provide greater or lesser air mixing prior to passage into plenum 51. The leading duct wall ends 65*a*–68*a*** act as diverters and are preferred present, but are optional.

The process seen in FIGS. 1 and 2 thus basically comprises following the exhaust gases from the furnace heat source substantially horizontally back and forth through the working furnace plenum chamber at a plurality of levels therewithin through a plurality of vertically spaced apart banks of heat exchanging tubes extending substantially the entire height of the furnace working plenum chamber. The cold air from the cold air return duct is flowed into a lower portion of the furnace plenum chamber and is thereafter divided into substantially as many parts as there are banks of heat exchange tubes and flowed upwardly in a separate set of individual flows through said banks. Thereafter the then heated air from the furnace working plenum chamber is collected (out of ducts 70–74, inclusive) and exhausted overhead therefrom into the hot air plenum 51 of the forced air circulating system. The cooled exhaust gases from the furnace heat source (combustion chamber 24) are vented from the system through duct 50 after passing out of the topmost bank 59 of heat exchange tubes.

FIGS. 3 AND 4 - HEAT EXTRACTOR

Referring to the heat conservation or extraction system and apparatus seen in FIGS. 3 and 4, same may be used with respect to any source of hot exhaust gases which is adjacent the cold and hot air ducting of a forced draft heating system. Its purpose is to extract or conserve the maximum amount of heat from the hot exhaust gases which would normally be vented to atmosphere. Typical sources of excessively hot (for conservation purposes) exhaust gases in residential homes, for example, include forced air furnace systems and gas hot water heaters. These both typically exhaust at approximately 200° F or hotter at the point of vent connection. A very considerable saving of fuel may be effected by decreasing this exhaust temperature 60%, which is the goal of the particular system. Additionally, heat pollution of the atmosphere is minimized.

Thus, specifically, be employment of the instant conservation system and apparatus with respect to 200° F or hotter exhaust gases from either or both a forced air furnace system or gas hot water heater, the temperature of such final exhaust after passing through the instant system would be reduced to approximately 85° F. It is well known that hot exhaust gases will rise and give proper venting if same are approximately 15° to 20° warmer than the atmospheric temperature.

The number of stages of heat exchange employed depend both on the amount of heat which is to be extracted and the amount of cold air furnished to the heat exchange stages and forced therethrough by blower action.

As in the case of the system and device of FIGS. 1 and 2, the several heat exchange stages each consist of a bank of heat exchanging tubes so positioned, spaced and ducted that each bank receives and has forced therethrough a portion of the available quantity of cold air to be heat exchanged. The tubes typically vary in size or number per stage, or both. That is, the bank of tubes receiving the hottest exhaust gases would typically be tubes lesser in number and larger in diameter, with the banks of tubes receiving therewithin the already partially cooled exhaust gases would typically be more in number and less in diameter. The tubes of each stage may have fins to aid in heat dissipation for transfer into the cold air being forced therepast.

As in the system and device of FIGS. 1 and 2, one blower may adequately handle smaller systems. One or more dampers may be employed to limit the flow of cold air through certain banks or stages of the heat exchange until the desired temperature is reached in the particular stage or stages blocked off from flow. Multi-speed blowers may be employed alone or in conjunction with damper control so that the blower speed increases as the effective temperature appears or the dampers open. On larger systems, two or more blowers may be required. The ducting within the heat extraction chamber, the total size of the chamber and the number and spacing of the tubes, as well as the available blower output are all gauged to the quantity of cold air available for heating and the heat available for heat exchange.

Referring to FIGS. 3 and 4, therein are shown two views of apparatus which provide a method of extracting heat from any heat source which exhausts heated gases adjacent a forced air circulating heating system. Thus, all that is required for the convenient installation of the device and system of FIGS. 3 and 4 are the relatively adjacent presence of a cold air return duct or plenum and a hot air circulation duct or plenum. The system and apparatus of FIGS. 3 and 4 could be employed in conjunction with the furnace of FIGS. 1 and 2, but not using the heat exhaust gases vented therefrom as a heat source, as there would be insufficient heat in such gases exhausted from furnace 10 of FIGS. 1 and 2.

In the views, at 100 there is seen a cold air return duct which may be main cold air return duct of a forced air heating system or a lesser artery in a system of same. At 101 there is seen a hot air circulation duct or plenum which may be the main sets or, again, merely a main artery in a system of same. Duct or plenum 101 is furnishing forced heated air therethrough to a work space to be heated from a source of heated air such as any typical hot air furnace or any conventional source of heated air for space heating. Duct 100 is returning cold air from such heated work space to the forced air furnace or the heated air source of the system.

There is provided a heat extraction chamber which is positioned at least in part below a length of the hot air circulation duct 101. This chamber is most conveniently substantially rectangular in both vertical sections and horizontal section and comprises upwardly angled top wall 102, upwardly angled bottom wall 103 and vertical side walls 104 and 105, as well as (for descriptive purposes) front wall 106 and rear wall 107. Front wall 106 has an opening 106*a* at its lower end centrally positioned thereof to receive the discharge from a blower, while top wall 102 has an opening 102*a* therein for exit of heated air out of the chamber generally designated 108.

A source of hot exhaust gases is schematically designated at 109 (FIG. 4) and typically, in a residential home, could comprise a hot air furnace or hot water heater. Hot exhaust gases from the combustion chamber or heat source therewithin would normally be vented via duct 110 to atmosphere externally of the home, but here, via elbow 111, duct 112 and reducing manifold fitting 113 same pass to the heat exhange means of the device and system of this instant improvement. Another convenient source of hot exhaust gases would be the existing boiler of a hot water system, whereby the basement of a house may be heated thereby or, with some duct work, a garage or the like.

In chamber 108 there are shown three separate banks (at least two) of heat exchange tubes, numbered (for each bank) 114, 115 and 116, respectively. Each of the tubes in the banks 114, 115 and 116 are received in and sealed through the side walls 104 and 105 to provide three vertically separated and staggered (from rear to front) (FIG. 3) sets or banks of heat exchange tubes. These banks are manifolded at 113, 117, 118, and 119. Manifold 113, as noted, passes the hot exhaust gases from heat source 109 vent 110 into the lowermost tube bank 114. Manifold 117 connects adjacent ends of banks 114 and 115, while manifold 118 connects adjacent ends of banks of 115 and 116. Manifold 119 collects the heat exchanged exhaust gases from heat source 109, passing same into duct 120, elbow 121 and vent duct 122 to atmosphere.

Duct defining interior walls 123 and 124 and provided extending between side walls 104 and 105 whereby to define (with walls 102, 103 and 107) three ducts 125, 126 and 127 within (in the view of FIG. 3) the righthand side of chamber 108. The banks of heat exchange tubes 114–116, inclusive are preferably staggered as seen in FIG. 3 with the tubes 114 furtherest away from opening 106*a* closely adjacent wall 107 and the tubes 116 opposite therefrom closely next wall 106. Thus the heat exchange tube banks 114–116, inclusive are staggered (in the view of FIG. 3) from right to left, upwardly. This provides a zone 128 to the left (in FIG. 3) of the leading ends 123*a* and 124*a* of walls 123 and 124 in the direction of air flow in chamber 108.

There is provided, communicating with and extending downwardly from cold air return duct 100, a cold air feed passageway or duct 129 which is defined by suitable sheet metal walls 130, 130*a* and wall 106 which feeds the cold return air through filter 131 and to one or more conventional centrifugal fans or blowers 132. The discharge duct 132*a* of blower 132 discharges through opening 106*a* in wall 106.

Sensors (FIG. 4) may be provided at 133 and/or 134 to control the damper action to be described or the blower operation or both. A damper 135 pivoted on arm or rod 136 pivots between the open position of FIG. 3 with cold air access from zone 128 to all of ducts 125, 126 and 127, to a closed position which shuts off passage of air through duct 127 and tubes 116. The heat exchange tubes which receive the hot exhaust gases from the heat source directly, namely, 114, are preferably less in number and larger in diameter than the tubes of succeeding banks, whereby the tubes in bank 116 are preferably of greater number and of lesser diameter than those in the other banks. Walls 124 and 123 may be of variable lenth in their vertical portions, whereby to provide zone 137 in the upper right-hand portion (FIG. 3) of chamber 108 for mixing of the hot air before passage of same into the hot air circulation duct 101. Walls 123 and 124 may end immediately after tube banks 115 and 116, respectively, to provide the maximum volume mixing chamber.

The intake side of the system of FIGS. 3 and 4 may be opened to the space surrounding the system to draw some of the surrounding air into chamber 108 for heating of same. This may conveniently be accomplished by providing an opening 138 in duct 130 above filter 131 having adjustable louvres 138*a* therein to control flow therethrough.

The output heated air from the ducts 125–127, inclusive may be flowed in some part out into the surrounding air space receiving chamber 108 for space heating. Such heated air would preferably be flowed out from chamber 108 opposite zone 137 (the output collecting zone) or from duct 101 adjacent opening 102. The latter would be downstream of the door 140. This output would be through one or more openings 139 having adjustable control louvres 139*a* therein. If the chamber 108 is positioned in a basement, valuable space heating, then, is available from chamber 108 for the basement area.

In order that the normal forced air heating system shown in FIGS. 3 and 4 utilizing hot air duct 101 and cold air return duct 100 may function efficiently when the system of FIGS. 3 and 4 is off as well as on, there is provided a door 140 overlying opening 102. Door 140 is hinged at 141 so that, when blower 132 is operating, door 140 may pivot upwardly, clockwise in the view of FIG. 4, around hinge 141, so that the air from chamber 108 may pass into duct 101. The air flow in duct 101 is in the direction indicated by arrows 143 so that, first, when blower 132 is off, the flow of air through duct 101 tends to maintain door 140 in closed position. This prevents any backflow of air through chamber 108 into the cold air return system. On the other hand, when blower 132 turns on, the air rising in ducts 125–127, inclusive, or part of them, causes the door 140 to pivot upwardly against the flow of air in duct 101 so that air from chamber 108 may discharge into duct 101, adjoining the air flow passage therethrough. Spring 142 is additionally provided in order to counter-balance the weight of door or closure 140 so that blower 132 will not have to fight too great a back pressure. When blower 132 goes off, door 140 returns to the full line position of FIGS. 3 and 4.

The operation of the unit of FIGS. 3 and 4 is naturally keyed to the emission of hot exhaust gases from the heat source 109. Thus, when the hot water heater or furnace 109 (for example) is turned on and vents heated gases through duct 110, the rise of temperature adjacent sensors 133 and/or 134, which corresponds to the beginning of the heating of the heat exchange ducts 114, may either switch on blower 132 or activate a timed delay turn on of same.

The improved system or method of extracting heat from a heat source which is exhausting heated gases adjacent a forced air circulating heating system involves the following. A heat extraction chamber is established which communicates between the cold air and hot air parts of the forced air circulating heating system, typically a cold air return duct and a hot air circulation duct. Hot exhaust gases from the source of heat are flowed back and forth, substantially horizontally, through the heat extraction chamber at a plurality of levels therewithin through a plurality of spaced apart banks or sets of heat exchange tubes. Cold air from the cold air return duct or cold side of the circulating heating system is flowed into the lower portion of said heat extraction chamber. In the chamber, this cold air input flow is divided into as many parts as there are banks of heat exchange tubes and flowed upwardly in a separated set of individual flows through each one of said banks. The then heated air is exhausted from the heat extraction chamber overhead into the hot air duct or hot side of the forced air circulating heating system, while the exhaust gases, cooled by heat exchange, are vented after passing through the topmost bank of the heat exchange tubes. When damper 135 is used, only a portion of the available ducts and banks of heat exchanging tubes are employed in the heat exchange system.

The heat extraction chamber of FIGS. 3 and 4 is shown with three vertically spaced and staggered sets of heat exchanging tubes. The tubes are shown in substantially horizontal orientation running parallel to one another. It is, of course, feasible to use but two banks of heat exchange tubes (with ducting and optional dampering) or three as shown, or more. The tube banks and ducts may be vertical, rather than horizontal, but the latter is preferred. The cold air is preferably from a cold air return duct, but may be from any source or, for example, a cold air return duct and exterior of the chamber 108 and cold air feed duct, 130, for example. Thus, in such a system positioned in a basement, intake could be provided from the basement space as well as the cold air return duct 100 in feed to chamber 108. Discharge from chamber 108 could be into both the basement space and the hot air duct 101.

In the feed to the furnace 10 (FIGS. 1 and 2) via ducts 45 and 45′, the flow into the furnace working plenum may be by gravity under certain circumstances, rather than employing blowers 48 and 48′. Additionally blower power may be provided elsewhere than that specifically illustrated in the forced air system. The same is true with respect to the system of FIGS. 3 and 4, namely, chamber 108 may be gravity fed from the cold air return duct 100 or the blower 132 may be placed elsewhere in the forced air system than that shown.

In FIGS. 1 and 2, the conventional pilot unit assembly, gas valve and limit controls are not shown for the sake of simplicity in illustration.

A down draft or down-flow furnace system having all of the advantages of the system of FIGS. 1 and 2 previously described may be provided by a simple reversal of parts in the figures seen. Thus, in FIGS. 1 and 2, by reversing the direction of forced air flow in the furnace 10 through the ducts 70–74, inclusive, there is no difference in the heat exchanging effect on the air passed through the ducts. This reversal of flow may be obtained by removing the blowers 48 and 48′ from the positions illustrated in FIG. 1 discharging into plenums 77 and 77*a* through front walls 11 and 15. Such blower or blowers 48 and 48′ are then mounted so as to discharge into the upper rear plenum 79 as seen at 48″ in FIG. 1. The discharge opening for output heated air from the system would exit from plenum 77, either through floor 23 (not shown) in front of wall 25 or through the front wall as seen at 51′. For an efficient downdraft system, the duct walls 65–67, inclusive would be largely or entirely removed above the tube banks 56–58, inclusive so as to provide a maximum plenum 78 feeding into the ducts 70–74, inclusive.

In such system, the opening 22 would be closed so that only vent 50 would emerge from the top of the furnace. Damper 75 would be effective in its illustrated position in the down flow system described. In operation of this system, air from the cold air return would pass into the upper plenum 78 through blower or blowers 48′, entering into ducts 70–74, inclusive. The air passed through these ducts would be heated by indirect heat exchange from the hot gases in the banks of heat exchange tubes 55–59, inclusive. The heated air then would exhaust from plenum 77 through the output duct or plenum 51′. In the event damper 75 was closed, the input air would pass only through duct 70 and 71 until the damper was open.

It is not necessary that the discharge from plenum 78 be overhead through opening 22. Alternatively, the opening for discharge of the heated air from plenum 78 may feed laterally through the upper portion of walls 12 and 16. In such case, the upper portions of duct walls 65–67, inclusive would be removed so as to provide a larger volume plenum 78 opposite the horizontal discharge plenum. Such an optional horizontal discharge plenum 51″ is shown in dotted lines on the upper right hand side of FIG. 1.

It is understood that the combustion chamber 24 of the furnace of FIGS. 1 and 2 is provided with sufficient air access openings through wall 27 that sufficient fresh air is provided to mix with the combustion gases from the burner outlets 30*a*, thereby to provide the necessary volume of heated gases passing upwardly out of the chamber 24 into manifold 52. A conventional access panel with filter thereon (not seen) may be provided to the left of wall 27 in FIG. 2.

From the foregoing, it will be seen that this invention is one well adapted to attain all of the ends and objects hereinabove set forth together with other advantages which are obvious and which are inherent to the process.

It will be understood that certain process features, steps and sub-combinations thereof are of utility and may be employed without reference to other features, steps and process subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. Apparatus for extracting heat from a heat source exhausting heated gases adjacent a forced air circulating heating system, said forced air system having at least one cold air return duct and a hot air circulation duct positioned adjacent one another, comprising, in combination:

a heat extraction chamber positioned at least in part below a length of the hot air duct, means for passing cold air from the cold air return duct into the lower part of the heat extraction chamber, means for passing heated air from the upper part of the heat extraction chamber into the hot air circulating duct, a plurality of sets of heat exchange tubes extending at least substantially across the heat extraction chamber at a plurality of vertically spaced levels therewithin, means for flowing exhaust gases from the heat source into one end of the lowermost set of heat exchanging tubes, manifolding means interconnecting the ends of the sets of heat exchange tubes with one another so that the exhaust gases flow back and forth through the banks of tubes in ascending fashion through the chamber, means for venting the exhaust gases from one side of the uppermost set of heat exchange tubes, wall means in said chamber dividing same into a plurality of ducts each of which includes one set of heat exchanging tubes, and means for exhausting air overhead from said chamber out of said ducts into said hot air circulating duct.

2. Apparatus as in claim 1 wherein the means for passing cold air from the cold air return duct into the lower part of the heat extraction chamber comprises a duct with blower means positioned therewithin.

3. Apparatus as in claim 1 wherein the number of sets of heat exchange tubes is at least three and damper means are provided whereby the entire flow of cold air from the cold air return duct may be channeled through the lowermost two sets of heat exchange tubes.

4. Apparatus as in claim 1 wherein the sets of heat exchange tubes are staggered with respect to one another in the heat extraction chamber with one side of the lowermost set against one defining wall of the heat extraction chamber and one side of the uppermost set of heat exchange tubes against the opposite defining wall.

5. Apparatus as in claim 1 wherein the cold air return duct and hot air circulation duct are positioned on substantially the same level with respect to one another and the means for passing cold air from the cold air return duct into the lower part of the heat extraction chamber comprises a substantially vertically extending duct including blower means positioned at the lower end thereof.

6. Apparatus as in claim 1 wherein said sets of heat exchange tubes are staggered within said heat extraction chamber so as to provide a lower plenum at one side of said chamber for said cold air entering same to feed the ducts containing said sets of heat exchange tubes.

7. Apparatus for effectively extracting substantially all of the useful heat from the heat source of a hot air furnace in a forced draft heating system in the plenum chamber of said furnace, comprising, in combination:

a hot air furnace including a combustion chamber and a furnace plenum chamber next to and above said combustion chamber for receiving air to be heated therewithin, a hot air plenum above said furnace plenum chamber to receive heated air therewithin for forced air distribution into the hot air ducts leading to the work space to be heated, a cold air return duct at the furnace returning cold air from the work space to be heated, means for passing cold air from the cold air return duct into the lower part of the furnace plenum chamber, means for passing heated air from the upper part of the furnace plenum chamber into the hot air plenum, a plurality of sets of heat exchange tubes extending at least substantially across the furnace plenum chamber at a plurality of vertically spaced levels therewithin, means for flowing exhaust gases from the combustion chamber into one end of the lowermost set of heat exchanging tubes, manifolding means interconnecting the ends of the sets of heat exchange tubes with one another so that the exhaust gases flow back and forth through the banks (sets) of tubes in ascending fashion through the chamber, means for venting the exhaust gases from one side of the uppermost set of heat exchange tubes, wall means in said furnace plenum chamber dividing same into a plurality of ducts, each of which includes one set of heat exchanging tubes, and means in said chamber for collecting the heated air from said ducts prior to passing same overhead from said chamber into said hot air plenum.

8. Apparatus as in claim 7 wherein the means for passing cold air from the cold air return duct into the lower part of the furnace plenum chamber comprises a duct with blower means positioned therewithin.

9. Apparatus as in claim 7 wherein the number of sets of heat exchange tubes is at least three and damper means are provided whereby the entire flow of cold air from the cold air return duct may be channeled through the lowermost two sets of heat exchange tubes.

10. Apparatus as in claim 7 wherein the sets of heat exchange tubes are staggered with respect to one another in the furnace plenum chamber with one side of the lowermost set positioned against one limiting wall of the furnace plenum chamber and one side of the uppermost set of heat exchange tubes positioned against the opposite limiting wall of the furnace plenum chamber, whereby the entire cross-sectional area of the furnace chamber is utilized in heat exchange transfer between the air being passed therethrough and the heat exchange tube sets therewithin.

11. Apparatus as in claim 7 wherein the means in said furnace plenum chamber for collecting the heated air from said duct prior to passing same overhead from said chamber into said hot air plenum comprises a zone at the top of the furnace plenum chamber above all of said sets of heat exchange tubes and duct wall means wherein the heated air flows may mix.

12. Apparatus as in claim 7 wherein said sets of heat exchange tubes are staggered in upward ascent through substantially the entire height of the furnace plenum chamber whereby to provide on one lower side thereof a common input chamber for cold air from the cold air return duct and on the opposite upper side thereof a common mixing chamber for hot air discharge from the upper end of said ducts.

13. Apparatus as in claim 7 including additional means for passing cold air from the cold air return duct into an intermediate height part or portion of the furnace plenum chamber and damper means in said furnace plenum chamber below said intermediate height cold air input adapted to separate same from the cold air input into the lower part of the furnace plenum chamber.

14. Apparatus for effectively extracting substantially all of the useful heat from the heat source of a hot air furnace in a forced draft heating system in the plenum chamber of said furnace, comprising, in combination:

a hot air furnace including a combustion chamber and a furnace plenum chamber next to and above said combustion chamber for receiving air to be heated therewithin, a hot air plenum associated with said furnace plenum chamber to receive heated air therewithin for forced air distribution into the hot air ducts leading to the work space to be heated, a cold air return duct associated with the furnace returning cold air from the work space to be heated, means for passing cold air from the cold air return duct into the upper part of the furnace plenum chamber, means for passing heated air from the lower part of the furnace plenum chamber into the hot air plenum, a plurality of sets of heat exchange tubes extending at least substantially across the furnace plenum chamber at a plurality of vertically spaced levels therewithin, means for flowing exhaust gases from the combustion chamber into one end of the lowermost set of heat exchanging tubes, manifolding means interconnecting the ends of the sets of heat exchange tubes with one another so that the exhaust gases flow back and forth through the banks (sets) of tubes in ascending fashion through the chamber, means for venting the exhaust gases from one side of the uppermost set of heat exchange tubes, wall means is said furnace plenum chamber dividing same into a plurality of ducts, each of which includes one set of heat exchanging tubes, and means in said chamber for collecting the heated air from said ducts prior to passing same from said chamber into said hot air plenum.

15. Apparatus for effectively extracting substantially all of the useful heat from the heat source of a hot air furnace in a forced draft heating system in the plenum chamber of said furnace, comprising, in combination:

a hot air furnace including a combustion chamber and a furnace plenum chamber next to and above said combustion chamber for receiving air to be heated therewithin, a hot air plenum associated with said furnace plenum chamber to receive heated air therewithin for forced air distribution into the hot air ducts leading to the work space to be heated, a cold air return duct associated with the furnace returning cold air from the work space to be heated, means for passing cold air from the cold air return duct into one vertical extremity of the furnace plenum chamber, means for passing heated air from the other vertical extremity of the furnace plenum chamber into the hot air plenum, a plurality of sets of heat exchange tubes extending at least substantially across the furnace plenum chamber at a plurality of vertically spaced levels therewithin, means for flowing exhaust gases from the combustion chamber into one end of the lowermost set of heat exchanging tubes, manifolding means interconnecting the ends of the sets of heat exchange tubes with one another so that the exhaust gases flow back and forth through the banks (sets) of tubes in ascending fashion through the chamber, means for venting the exhaust gases from one side of the uppermost set of heat exchange tubes, wall means in said furnace plenum chamber dividing same into a plurality of ducts, each of which includes one set of heat exchanging tubes, and means in said chamber for collecting the heated air from said ducts prior to passing same from said chamber into said hot air plenum.

* * * * *